US006088865A

United States Patent [19]

Truan et al.

[11] Patent Number: 6,088,865

[45] Date of Patent: Jul. 18, 2000

[54] VEHICLE MOUNTED BROOM

[75] Inventors: Charles Joseph Truan, Royal Oak; James Phillip Truan, Berkley; Timothy William Hewitt, Pleasant Ridge, all of Mich.

[73] Assignee: Trynex, Inc., Royal Oak, Mich.

[21] Appl. No.: 09/019,099

[22] Filed: Feb. 5, 1998

Related U.S. Application Data

[60] Provisional application No. 60/037,308, Feb. 5, 1997, and provisional application No. 60/065,833, Nov. 17, 1997.

[51] Int. Cl.[7] ..... E01H 1/02

[52] U.S. Cl. ..... 15/78; 15/79.2; 15/190

[58] Field of Search ..... 15/49.1, 78, 79.1, 15/79.2, 171, 184, 190, 194, 204, 201–203, 340.3, 159.1

[56] References Cited

U.S. PATENT DOCUMENTS

| | | |
|---|---|---|
| 1,189,016 | 6/1916 | Thompson . |
| 2,101,769 | 12/1937 | Westmoreland . |
| 2,268,519 | 12/1941 | Teager . |
| 2,300,192 | 10/1942 | Allen . |
| 2,561,025 | 7/1951 | Le Febvre . |
| 2,789,298 | 4/1957 | Peterson . |
| 2,855,618 | 10/1958 | Jones . |
| 2,973,535 | 3/1961 | Olay . |
| 2,989,766 | 6/1961 | Hoag . |
| 3,086,236 | 4/1963 | Anonsen . |
| 3,129,944 | 4/1964 | Amos et al. . |
| 3,134,129 | 5/1964 | Allen . |
| 4,747,174 | 5/1988 | Hightower . |
| 5,182,830 | 2/1993 | Viola . |
| 5,549,413 | 8/1996 | Bolden . |
| 5,621,940 | 4/1997 | Lewis et al. . |
| 5,819,357 | 10/1998 | Gould . |

*Primary Examiner*—Terrence R. Till
*Assistant Examiner*—Jennifer McNeil
*Attorney, Agent, or Firm*—Howard & Howard

[57] ABSTRACT

A vehicle mounted broom that has a modular construction, improved sweeping action and versatile mounting capabilities. The modular construction allows wings to be attached to the main housing to increase the length of the broom and, if desired, the sweep angle. The broom has uniquely configured brushes that reduce greatly or eliminate rocking of the brushes with respect to the housing to which they are removably mounted. The versatile mounting system includes mounting brackets fixed to the housing which receive various mounting packages for mounting to different vehicles.

11 Claims, 3 Drawing Sheets

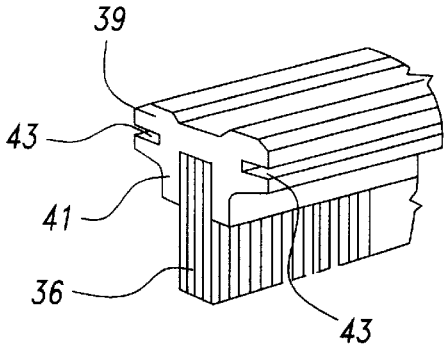
Fig-3
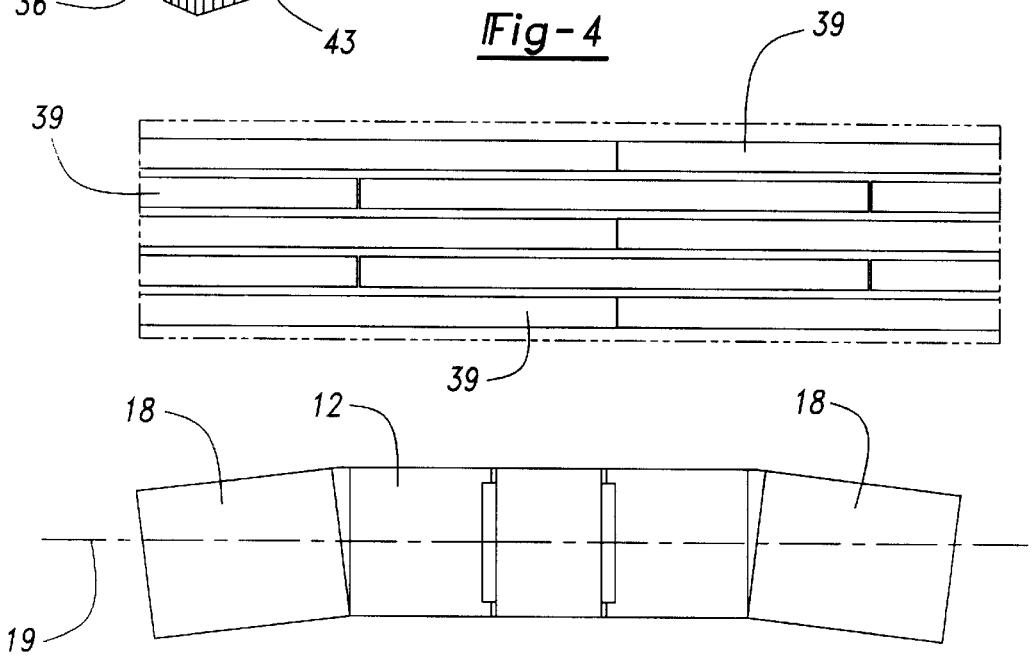
Fig-4
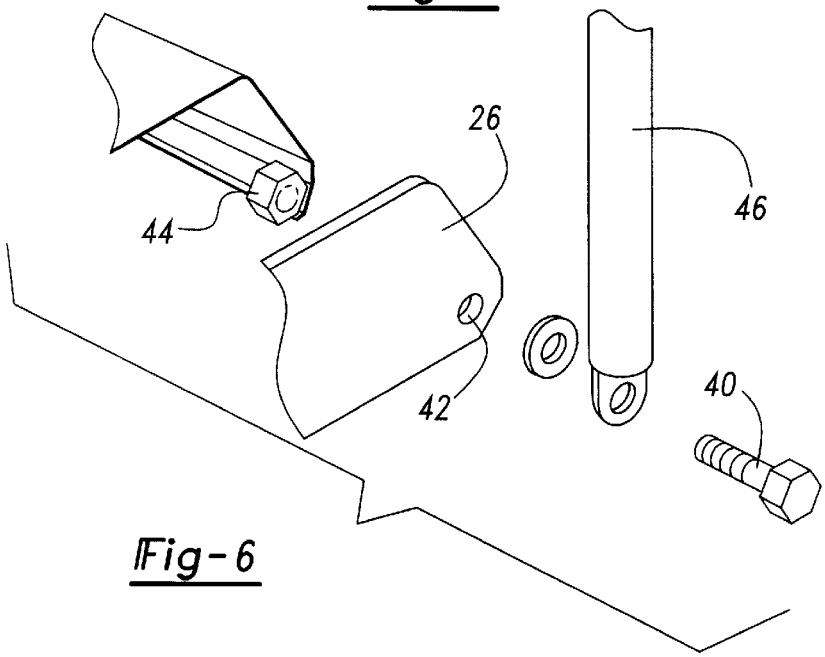
Fig-5
Fig-6

VEHICLE MOUNTED BROOM

This application claims the benefit of provisional application number 60/037,308 filed Feb. 5, 1997 and provisional application No. 60/065,833 filed Nov. 17, 1997.

FIELD OF THE INVENTION

The present invention generally relates to vehicle mounted brooms and more particularly to fixed vehicle mounted brooms. Fixed vehicle mounted brooms typically have a rectangular housing that receives a plurality of brushes that are loosely mounted in tracks in the housing. The brushes of the broom are loosely mounted so that they can be easily replaced as the brushes wear. The housing generally includes a mounting assembly to allow the broom to be mounted to a vehicle, such as for example to the snow plow attachment on a pick-up truck. The pick-up truck can then be used to push or pull the broom to sweep an area.

BACKGROUND

Vehicle mounted brooms are well known. A common type of vehicle mounted broom is a rotary broom. Rotary brooms are mounted on specially designed vehicles for sweeping purposes only. The brooms are typically a circular disk with bristles mounted to the disk in a circular pattern. The brooms are spun at high RPM on a drive axis to sweep in a circular manner. Because of the spinning action of these brooms, there is considerable dust when sweeping. To reduce the dust, some of these vehicles have vacuum systems that vacuum while sweeping is being done.

Rotary brooms are very expensive, they include the broom, the drive mechanism and the vehicle and the vehicle can only be used for sweeping. The entire purchase price is attributed to the sweeping function because of the single vehicle use. In addition to being expensive, the rotary brooms require fairly high maintenance, particularly when compared to fixed vehicle mounted brooms. They also have a problem with excessive dust which limits their use to applications where large amounts of airborne dust particles are not a problem. They are also of no value in sweeping larger objects, such as chunks of wood, metal parts, etc.

Another type of rotary broom is the drum type broom. This broom is shaped like a drum and has bristles mounted about the periphery of the drum. The broom is mounted for rotation about an axis that extends generally parallel to the longitudinal centerline of the drum. The drum type rotary broom suffers from the same disadvantages as the disc type rotary broom.

Fixed vehicle mounted brooms have no moving parts. They are typically made up of several rows of bristles which are mounted to the underside of a housing which is then mounted to a vehicle, such as for example a pickup truck. By way of example, with pickup trucks, the brooms can be mounted to the vehicles snow plow mounting assembly and raised and lowered for use. When compared to rotary brooms, fixed vehicle mounted brooms are very inexpensive and have little maintenance. The only maintenance that is required is bristle replacement.

In the vehicle mounted broom disclosed in U.S. Pat. No. 5,621,940, the brushes are loosely mounted within generally C-shaped tracks. The bristles of the brushes are mounted within an elongated holder 5 that is received within each of the respective tracks 4. The holder has a head which is slightly larger than the opening in the track to prevent it from falling out of the track, but is smaller than the interior of the track to allow easy insertion, removal and a rocking action.

The C-shaped tracks are mounted to the bottom of the housing 1 by spot welding the tracks to the metal housing 1. An angle bracket 2 is also used to hold the bristles in the tracks after they have been inserted.

Although the fixed vehicle mounted broom of U.S. Pat. No. 5,621,940 has advantages over rotary brooms, it still has several disadvantages. One of the main problems is that the loosely fitted bristles reduce the effectiveness of the brooms sweeping capabilities. The bristles ability to rock in their tracks allows dirt, objects to be swept, water, etc. to be swept over and missed by the broom. Another disadvantage is the inability to modify the sweeping length of the broom or its sweeping angle. A still further problem is the positioning of the bristles closely adjacent the housing edges. There is no dust collection and retention zone due to this positioning of the bristles with respect to the housing edge. An additional problem is the limited versatility of the mounting assemblies. The mounting assemblies of the known vehicle mounted brooms do not allow the broom to be easily and quickly mounted to different types of vehicles.

SUMMARY OF THE INVENTION

The present invention overcomes the problems found in known rotary and fixed vehicle mounted brooms. The broom of the present invention has a housing with multi-purpose mounting brackets connected to the top of the housing for mounting the broom to a vehicle. A first set of brush mounting tracks are mounted to the bottom of the housing for receiving brushes. The first set of mounting tracks extend generally parallel to one another and longitudinally along the housing.

The broom includes attachment brackets for receiving at least one wing for attachment to the housing to increase the length of the vehicle mounted broom. The wing has mating connection brackets for interconnection to the attachment brackets. The wing has a second set of brush mounting tracks mounted to the bottom of the housing for receiving brushes. The second set of mounting tracks extend generally parallel to one another and longitudinally along the wing, and are aligned with the main brush mounting tracks on the housing. Elongated brushes are inserted into the first and second set of mounting tracks so that the vehicle mounted broom can be extended by the attachment of one or more wings. The wing can be angled to provide a vehicle mounted broom that has at least one section angled with respect to the housing.

The elongated brushes have a head portion with a plurality of bristles extending from the head portion. The bristles of the preferred embodiment are single member brushes mounted adjacent to one another along the length of the brush. The elongated brushes include a head portion for mounting within the first and second brush mounting tracks. The flanges of the tracks engage the head portion to retain the head portion within the respective track.

Each of the first and second tracks have a longitudinal centerline and the brushes are mounted within the first and second tracks so that the brushes do not pivot more than 5° about the longitudinal centerline but are still easily removed and replaced by sliding them into and out of the track. In the preferred embodiment the head portion of the brush includes a top, sides and a base, the base includes a recess to receive the bristles, and the sides include grooves to receive the brush track flanges to lock the brush into the tracks to prevent the brush from rocking within the track to maintain the brushes in a relatively fixed relationship to one another. In this way, the brushes act like separate fixed walls or curtains to scrape the surface being swept. In the event the bristles bend and allow debris to pass to the next brush, that next brush acts as a wall, and so on through each row of brushes.

The mounting brackets of the broom include support members mounted to the top of the housing and at least four pockets for receipt of the tines of a forklift. At least two tangs are mounted to the support members for the receipt of the edge of a bucket. The combination of mounting bracket and tangs allows easy versatile attachment to the tines of a forklift or the cutting edge of a vehicle bucket. The unit also has an attachment for mounting to the mounting assembly of a snowplow or to a three point hitch assembly.

DESCRIPTION OF DRAWINGS

FIG. 3 is a partial perspective view of a brush.

FIG. 4 is a top view of the brush alignment.

FIG. 5 is a top view of the vehicle mounted broom with angled wing sections attached.

FIG. 6 is a partial side view of the vehicle mounted broom illustrating attachment of the end cap.

DETAILED DESCRIPTION OF THE INVENTION

Figure 1:
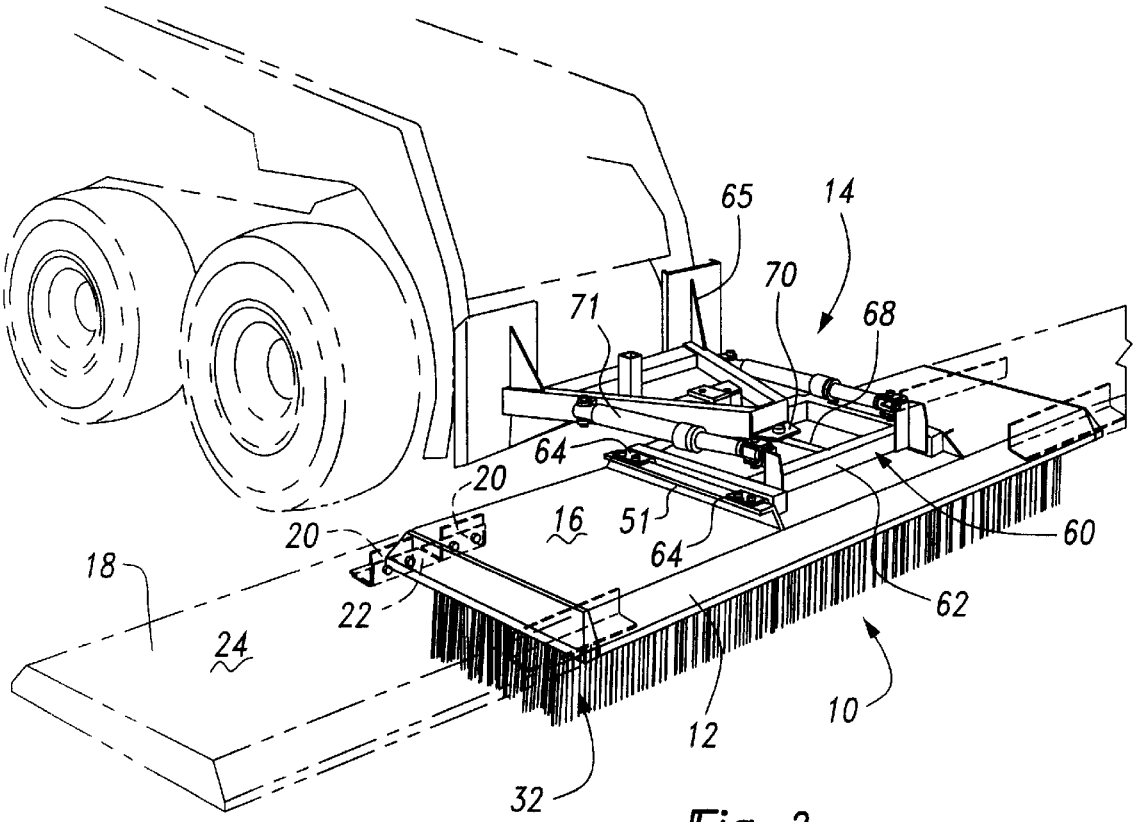
FIG. 1 is a perspective view of the vehicle mounted broom of the present invention including wing attachments shown in phantom.
Figure 7:
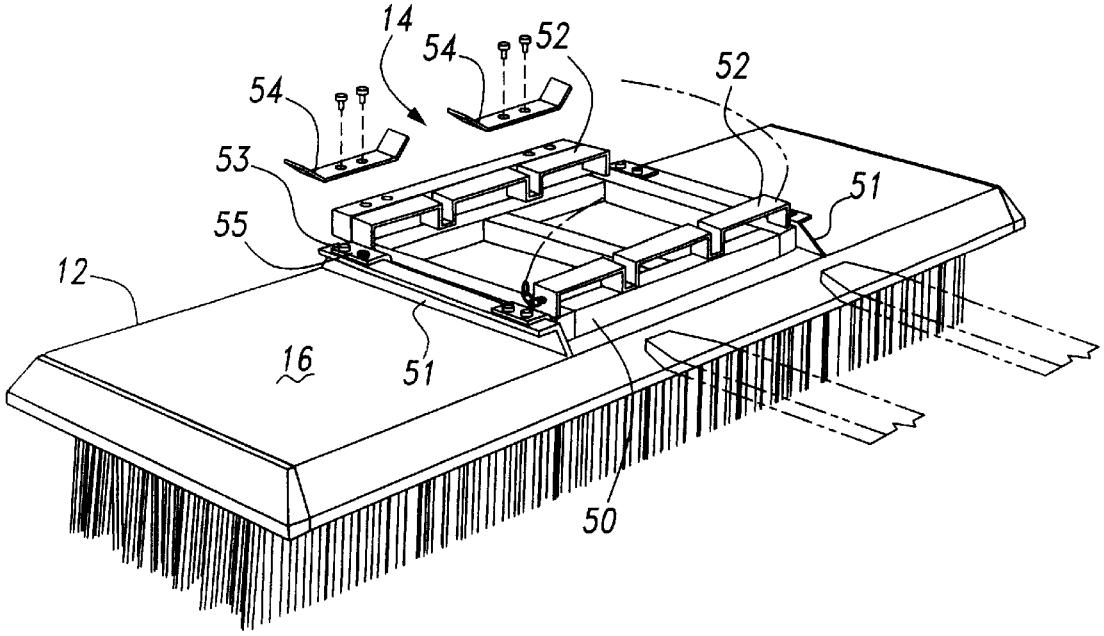
FIG. 7 is a perspective view of the vehicle mounted broom of the present invention having a mounting module attached.
Figure 8:
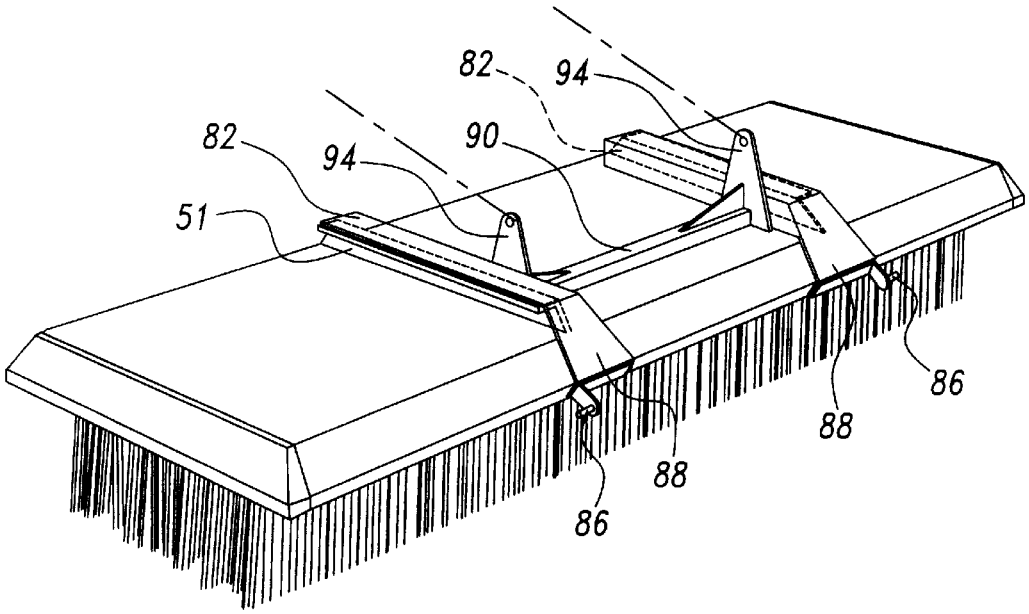
FIG. 8 is a perspective view of the vehicle mounted broom with mounting module attached.

The present invention relates to a vehicle mounted broom shown generally at 10. The broom 10 has a main frame 12. A mounting assembly shown generally at 14 is attached to the top 16 of the main frame 12. The mounting assembly 14 can be a type that accepts a three point style hitch as shown in FIG. 1. It can also be a dual mount assembly which can be used to mount the tines or teeth of a forklift or similar device as shown in FIG. 7. It can also be used to mount the bucket of a loader, such as a front loader. Also as shown in FIG. 8, the vehicle mounted broom can be mounted to a standard snowplow hitch. This permits the broom to be quickly and easily mounted to the front of a standard pick-up truck having a snowplow hitch assembly. Overall, the broom is extremely versatile and can be mounted, depending upon the mounting assembly used, to various types of vehicles.

The broom 10 has a modular construction. Modules or wings 18, which are shown in phantom, are attached to the main frame 12. The modules can be attached to both sides of main frame 12 or to either side, depending upon the desired width of broom 10.

The main frame 12 and wings 18 have mounting brackets 20 for receipt of a mating connecting bracket 22. As disclosed, brackets 20 are sections of angle iron with two legs and have threaded openings in each leg for receipt of a bolt 28. The connecting brackets 22 are preferably sections of angle iron and have openings to mate with openings in brackets 20. The connecting bracket 22 is abutted against the sides of the mounting brackets 20 and bolts 28 are threaded into the threaded openings through the openings to attach the wings 20 to the main frame 12. As shown, nuts 29 are attached to the bolts 28, but this is only optional and would not be necessary with the threaded openings. Once attached, the extended broom 10 appears to be of unitary construction and sweeps as if it were a single housing with an elongated broom. The surface 16 is generally co-planar with the surface 24 of wing 18 to give the appearance of a single housing.

As shown in FIG. 5, the wings 18 can be angled with respect to the longitudinal center line 19 of the broom. Both sides or either one of the sides can include an angled wing 18. The angled wings are mounted to the main frame 12 in the same manner as the previously described wings 18.

Brushes 32 are mounted to the underside of the main frame 12, and if wings are present to the underside of the wings. The brushes 32 of the broom 10 are formed in long strips which are received within tracks 34 formed on the underside of the frame 12 and wings 18. Preferably, the tracks 34 are welded to the underside of frame 12. In the preferred embodiment, the brushes 32 are defined by a plurality of single bristles 36 mounted adjacent to one another and extending from a mounting strip 38. Said another way, the brushes 32 in the preferred embodiment are constructed of a plurality of single bristles 36, not double or triple strands folded to form the separate bristles. Each of the brushes 32 are slid into a corresponding mounting track 34 to form a series of spaced brushes for sweeping.

Figure 2:
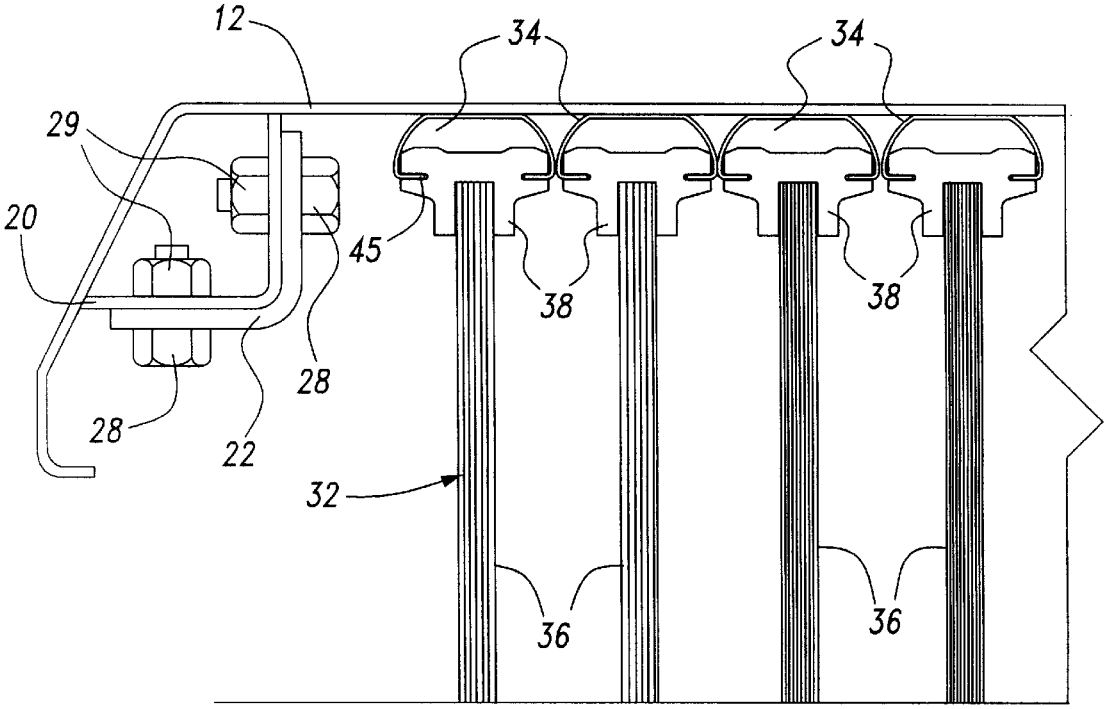
FIG. 2 is a partial end view with the end cap removed illustrating the brush attachment and the mounting brackets for connecting wing sections to the housing.

As illustrated in FIG. 3, the mounting strip 38 has a head portion 39 and a body 41. The bristles 36 are secured in the body 41 by glue, welding or other readily available and known techniques. In the preferred embodiment, the head portion extends the full length of the body portion, but it should be understood that the head portion 39 may not extend along the length of the body 41 but might be spaced along the body 39. The head portion 39 includes recesses 43 that extend along the length of the head portion 39. The recesses 43 are configured to receive the flanges 45 on the tracks 34. As can be seen in FIG. 2, the tracks 34 are generally C-shaped in cross section with the flanges 45 extending across the opening formed by the track 34 to partially close the track opening. The interaction between the recesses 43 in the head 39 and the flanges 45 prevent the brushes 32 from rocking with respect to the track 34 and the housing.

The brushes 32 are relatively fixed with respect to the tracks 34 and have only slight movement with respect to the track 34 if any movement at all. This locking of the brushes 32 with respect to the broom provides a far superior sweeping broom because the brushes 32 act as a series of spaced walls or squeegees that engage and push the debris along the sweeping path. Debris that passes through the first row of brushes 32 is caught by the second row and debris that passes the second row is caught by the third etc. The sweeping capabilities of the broom of the present invention are so good that the broom can be effectively used to move water as well as debris. But, as should be appreciated, the brushes 32 can still be easily removed by sliding them from the tracks. They are held to prevent rocking, but still slide for replacement purposes.

With reference to FIG. 6, each of the sides of the main frame 12 has a removable cap 26. The cap 26 secures the brushes 32 within the tracks 34 so that they cannot inadvertently slide out of the tracks 34. The cap 26 mounts to the main frame 12 by a bolt 40 inserted through opening 42 and threaded into nut 44. Nut 44 is preferably welded to main frame 12. In the illustrated embodiment, markers 46 are attached to the cap 26 to enhance the operator's visibility.

In the preferred embodiment, the main frame 12 is approximately either forty-eight inches wide or sixty inches wide. If only the main frame is used for sweeping, forty-eight inch or sixty inch wide bristles are supplied and mounted within the tracks 34. Preferably, there are eleven tracks, but smaller units can be made with, for example, seven tracks. If wings are attached to the main frame 12, additional brush strips 32 are provided. If for example, eighteen inch wide wings 20 are supplied, additional brush strips 32 are provided in twenty and sixteen inch lengths. The overall brush length is then eighty-four inches and it is made up of forty-eight, twenty and sixteen inch brushes. The brushes are mounted within the tracks so that the ends of each of the respective brush strips overlap an adjacent brush section row so that there are no adjoining gaps between the rows of brush strips in the direction of sweeper movement. This can be seen in FIG. 4. In effect, the brush sections 32 are mounted in a brick-like manner.

With reference to FIG. 7, the dual mounting assembly will be described. The mounting assembly 14 has a frame 50 which is mounted to the top 16 of the main frame 12. Preferably, frame 50 is juxtaposed with the top 16 to maintain a low center of gravity to prevent tipping of the broom as it is being used or connected to the vehicle. In the disclosed embodiment, the main frame 12 has mounting flanges 51 to which the frame 50 can be easily mounted by bolts 53 through angle brackets 55. Mounted to the frame 50 are six pockets 52. These pockets are adapted to receive the tines of for example, a forklift. Six pockets are illustrated to allow the insertion of various teeth of a forklift. For example, a forklift used to lift bricks will have closely spaced forks which can be received within the pockets 52. In addition, there are two spaced tangs 54 which permit a bucket to be inserted under the tangs for attaching the broom to the bucket of a vehicle. In the preferred embodiment, the bucket would be inserted over the pockets 52 opposite the tangs 54 and then under the tangs 54. To secure the broom to the bucket, the broom can then be chained to the bucket. In the preferred embodiment, hooks or eyebolt connectors are used for connecting a chain between the broom and the bucket.

The broom 10 can also have a mounting assembly 14 for a pivot hitch mounting assembly 60 as illustrated in FIG. 1. Hitch assembly 60 has a rectangular frame 62 which mounts through brackets 64 to the flanges 51 on the main frame 12. The frame 62 includes a middle bar 68 and a pivot bracket 70. The middle bar 68 receives the point of a pivot hitch and the pivot bracket 70 receives a pin that is mounted through a mating pivot bracket 72 on the pivot hitch 65. The same hitch assembly 60 can be used with a three-point pivot hitch. Additionally, hydraulic cylinders 71 can be mounted between the vehicle and the broom hitch assembly to allow pivoting action to be controlled hydraulically.

With reference to FIG. 8, a mounting assembly 14 to accommodate a snowplow hitch assembly is illustrated. The assembly 14 has a mount 82 that attaches to the flanges 51. Preferably, the mount 82 is attached with bolts. Lift arm pins 86 are mounted to the end of the mount 82 to brackets 88. A spreader 90 is mounted to the inside of the mount 82. Hydraulic cylinders (not shown) are connected to the ears 94 of the spreader 90. This assembly allows easy attachment of the broom to the snowplow hitch of a vehicle such as for example a pick-up truck after the snowplow blade has been removed. As will be appreciated, the broom can then be moved in the same manner as the snowplow blade.

It will be appreciated that the above description relates to the disclosed embodiment by way of example only. Many apparent variations of the disclosed invention will be known to those of skill in this area and are considered to be within the scope of this invention and are considered to be within the scope of the following claims.

What is claimed is:

1. A vehicle mounted broom comprising:

a housing having a top surface and a bottom surface;

mounting fixtures connected to the top surface of the housing to enable the housing to be mounted to a vehicle;

a first set of brush tracks fixed to the bottom surface of the housing for receiving brushes, the first set of brush tracks extending generally parallel to one another and longitudinally across the housing;

at least one wing adapted to be connected the housing to increase the overall length of the housing, the wing having a top and bottom surface and a second set of brush tracks fixed to the bottom surface of the wing, the second set of brush tracks extending generally parallel to one another and longitudinally across the housing and aligned with the first set of brush tracks;

elongated brushes removably mounted in the first and second set of brush tracks to create a series of spaced rows of brushes within the housing;

mating mounting brackets connected to the housing and the wing to permit removable mounting of the wing to the housing, said mounting brackets permitting fixed rigid connection of said wing to said housing such that said wing doesn't move with respect to said housing;

whereby the vehicle mounted broom can be extended by the attachment of one or more wings to various desired lengths and permit the cooperative mounting of elongated brushes.

2. The vehicle mountable broom of claim 1, wherein the housing has a longitudinal center line and at least one wing is angled with respect to the longitudinal center line of the housing, whereby the mounting of the wing to the housing provides a vehicle mounted broom having at least one section angled with respect to the longitudinal center line of the housing.

3. The vehicle mountable broom of claim 2, wherein the angled wing top surface and the housing top surface are generally an uninterrupted surface.

4. The vehicle mountable broom of claim 3, wherein each of the first and second tracks have a longitudinal centerline and the brushes are mounted within the first and second tracks such that the brushes do not pivot more than 5° about the longitudinal centerline.

5. The vehicle mounted broom of claim 1, wherein the first and second brush tracks are generally C-shaped in cross section having an outwardly facing opening with flanges partially closing the opening.

6. The vehicle mounted broom of claim 5, wherein the elongated brushes have an elongated head portion with a plurality of bristles extending from the head portion.

7. The vehicle mountable broom of claim 6, wherein each of the first and second tracks have a longitudinal centerline and the brushes are mounted within the first and second tracks such that the brushes do not pivot more than 5° about the longitudinal centerline.

8. The vehicle mountable broom of claim 6, wherein the head portion includes a top, sides and a base with the base including a recess to receive the bristles, and the sides include grooves to receive the flanges to lock the brush into the tracks to prevent the brush from rocking within the track to maintain the brushes in a relatively fixed relationship with respect to one another.

9. The vehicle mounted broom of claim 5, wherein the elongated brushes include a head portion adapted for mounting within the first and second mounting tracks with the flanges adapted to engage the head portion to retain the head portion within the respective track.

10. The vehicle mountable broom of claim 1, wherein each of the first and second tracks have a longitudinal centerline and the brushes are mounted within the first and second tracks such that the brushes do not rock more than 5° about the longitudinal centerline.

11. The vehicle mounted broom comprising:

a housing having a plurality of spaced tracks for removable receipt of broom brushes wherein the plurality of spaced tracks have a generally c-shaped cross section with an opening that is partially closed by flanges;

a plurality of broom brushes for sliding into the space tracks, wherein each of the plurality of broom brushes has a mounting head from which a plurality of bristles extend, each mounting head having opposed sides, each with a longitudinally extending groove for receipt of the flanges;

the brushes being retained in the tracks to limit pivitol movement of the brushes with respect to the track.

* * * * *